US011523716B2

(12) United States Patent
Marietta-Tondin et al.

(10) Patent No.: US 11,523,716 B2
(45) Date of Patent: Dec. 13, 2022

(54) DISPENSER ASSEMBLY

(71) Applicant: SCA TISSUE FRANCE, Saint-Ouen (FR)

(72) Inventors: Julien Marietta-Tondin, Marckolsheim (FR); Yves Stoeffler, Sarreguemines (FR); Gilles Cattacin, Colmar (FR)

(73) Assignee: ESSITY OPERATIONS FRANCE, Saint-Ouen (FR)

( * ) Notice: Subject to any disclaimer, the term of this patent is extended or adjusted under 35 U.S.C. 154(b) by 0 days.

(21) Appl. No.: 14/778,662

(22) PCT Filed: Mar. 22, 2013

(86) PCT No.: PCT/IB2013/000455
§ 371 (c)(1),
(2) Date: Sep. 21, 2015

(87) PCT Pub. No.: WO2014/147432
PCT Pub. Date: Sep. 25, 2014

(65) Prior Publication Data

US 2016/0051098 A1 Feb. 25, 2016

(51) Int. Cl.

| | |
|---|---|
| ***A47K 10/38*** | (2006.01) |
| ***A47K 10/16*** | (2006.01) |
| ***A47K 10/32*** | (2006.01) |

(52) U.S. Cl.
CPC ..... *A47K 10/3827* (2013.01); *A47K 10/16* (2013.01); *A47K 2010/3233* (2013.01);
(Continued)

(58) Field of Classification Search
CPC ..... A47K 10/3827; A47K 10/16; A47K 2010/3233; A47K 2010/3863;
(Continued)

(56) References Cited

U.S. PATENT DOCUMENTS 400,913 A 4/1889 Hicks
666,182 A * 1/1901 Cardwell ..... 242/595.1 X
(Continued)

FOREIGN PATENT DOCUMENTS

CH 394 868 * 12/1965 ..... A47K 10/3827
EP 0404066 A1 12/1990
(Continued)

OTHER PUBLICATIONS

Russian Office Action dated Jan. 24, 2017 issued in counterpart Russian patent application No. 2015145185 (1 page) and its English-language translation thereof (3 pages).
(Continued)

*Primary Examiner* — Clark F Dexter
(74) *Attorney, Agent, or Firm* — Buchanan Ingersoll & Rooney PC

(57) ABSTRACT

A dispenser assembly designed to tangentially dispense a sheet from a roll of sheet material including sheet material formed from two webs, each web having lines of weakness positioned transversely across the web which allows the web to be separated into a plurality of sheets, the lines of weakness of one web being offset from those of the other web. The dispenser assembly includes (1) a base arranged to hold the roll of sheet material and to couple the dispenser assembly with an environment structure; (2) a first roller and a counter roller between which the sheet material is movable towards a dispensing outlet; and (3) a cradle arranged to support the roll of sheet material and to unwind the sheet material towards the first roller whatever a consumption level of the roll of sheet material. The first roller and the counter roller are positioned relatively to each other spaced according to a fixed nip therebetween to generate a braking force on the sheet material sufficient to break the line of
(Continued)

weakness of the web at the dispensing outlet or downstream the dispensing outlet.

12 Claims, 9 Drawing Sheets

(52) U.S. Cl.
CPC ..... *A47K 2010/3863* (2013.01); *Y10T 83/896* (2015.04); *Y10T 225/246* (2015.04)

(58) Field of Classification Search
CPC ..... A47K 10/3206; A47K 10/3612; A47K 10/3631; A47K 10/3637; A47K 10/3643; A47K 10/3675; Y10T 83/896; Y10T 83/902; Y10T 225/246; Y10T 225/282
USPC ..... 225/46, 77; 83/649, 650; 242/594.1, 242/595, 595.1
See application file for complete search history.

(56) References Cited

U.S. PATENT DOCUMENTS 766,266 A * 8/1904 Krauth ..... B42D 19/00 286/1
1,122,672 A * 12/1914 Winter et al. ..... B65H 35/0006 225/42
1,122,673 A * 12/1914 Winter et al. ..... A47K 10/3818 225/106
1,270,580 A * 6/1918 Wolf ..... B65H 35/0026 225/33
1,967,119 A * 7/1934 Gluck ..... B65H 35/002 225/42
2,003,044 A * 5/1935 Galante ..... B65H 35/0006 225/42
2,038,822 A * 4/1936 Bins ..... A47K 10/3827 225/46
2,047,255 A * 7/1936 Colburn ..... B65H 35/0006 225/42
2,319,071 A * 5/1943 Mason ..... B65H 35/002 225/42
2,683,641 A * 7/1954 Larson ..... A47K 10/3827 225/43
2,824,774 A * 2/1958 Embree ..... A47K 10/3827 225/23
2,839,346 A * 6/1958 Lawalin ..... A47K 10/3827 225/34
2,872,264 A * 2/1959 Nehring ..... A47K 10/3827 242/560.3
2,946,636 A * 7/1960 Penney ..... A47K 10/3827 312/34.22
2,957,738 A 10/1960 Marcuse
3,022,957 A 2/1962 Blunt et al.
3,045,883 A * 7/1962 Andrews et al. .. A47K 10/3827 225/46
3,084,006 A * 4/1963 Roemer ..... A47K 10/3827 312/34.22
3,156,391 A * 11/1964 Wicksall ..... B65B 61/10 225/34
3,237,826 A * 3/1966 Ringholz et al. .. B65D 83/0882 206/409
3,472,463 A * 10/1969 Fedor et al. ..... B21C 47/22 242/560.2
3,489,361 A * 1/1970 Marion et al. ..... B41J 15/04 242/562
3,770,172 A 11/1973 Nystrand et al.
3,972,487 A * 8/1976 Costa ..... B65H 19/126 242/558
4,165,138 A * 8/1979 Hedge et al. ..... A47K 10/3656 242/560
4,344,605 A * 8/1982 Ganseuer et al. ..... B23D 31/00 266/48
4,399,729 A * 8/1983 Malinowski et al. . B23D 19/00 242/562
4,408,811 A * 10/1983 Richardson et al. .. A47K 10/24 312/138.1
4,537,106 A * 8/1985 Rider ..... B65H 49/24 242/129.5
4,699,034 A * 10/1987 Sue ..... B41J 15/042 242/564
4,811,878 A * 3/1989 Horinchi ..... A47K 10/32 221/44
5,095,586 A * 3/1992 Wust et al. ..... D01G 19/08 19/115 R
5,367,746 A * 11/1994 Clement et al. ..... D01G 19/08 19/115 R
5,549,232 A * 8/1996 Scholfield ..... B42D 19/00 225/46
5,601,253 A * 2/1997 Formon et al. .... A47K 10/3827 242/595.1
5,605,265 A * 2/1997 Hanna ..... A47K 10/38 206/409
6,302,351 B1 * 10/2001 Omdoll et al. ..... A47K 10/36 242/564.2
6,592,013 B1 * 7/2003 Fujiwara ..... A47K 10/38 225/39
7,168,653 B2 * 1/2007 Omdoll et al. .... B65H 35/0006 242/564.2
7,354,015 B2 4/2008 Byrd et al.
8,899,508 B2 * 12/2014 Hjort et al. ..... B65H 16/106 242/564.4
2004/0251293 A1 * 12/2004 Hirai et al. ..... A47K 10/38 225/46
2008/0078777 A1 * 4/2008 Cittadino et al. .... B65H 16/005 221/1
2010/0012674 A1 * 1/2010 Brownlee ..... A47K 10/3625 221/1
2011/0253762 A1 10/2011 Wang
2011/0276178 A1 * 11/2011 Petersen et al. ... B65H 35/0006 700/236
2017/0112336 A1 * 4/2017 Ruthven et al. ... A47K 10/3643

FOREIGN PATENT DOCUMENTS

FR 1322662 * 2/1963 ..... A47K 10/3827
GB 222012 * 1/1962 ..... A47K 10/3827
GB 1 596 772 * 8/1981 ..... A47K 10/3827
WO WO-2007/068883 A1 6/2007
WO WO 2008/129572 A1 * 10/2008 ..... A47K 10/3827

OTHER PUBLICATIONS

Office Action with a response date of Jul. 18, 2017 issued in Columbian Patent Application No. 5611 (7 pages) with an English translation (9 pages).
Mexican Office Action dated Sep. 19, 2018, issued in counterpart Mexican Patent Application No. MX/a/2015/013462 (partial translation attached).

* cited by examiner

DISPENSER ASSEMBLY

CROSS-REFERENCE TO PRIOR APPLICATION

This application is a § 371 National Stage Application of PCT International Application No. PCT/IB2013/000455 filed Mar. 22, 2013, which is incorporated herein in its entirety.

TECHNICAL FIELD

An aspect of the disclosure relates to a dispenser assembly. Such a dispenser assembly finds a particular, though non-exclusive, application in dispensing tissue paper roll of the type including two overlapping webs formed into a single roll.

BACKGROUND

Tissue paper rolls of the type including two overlapping webs formed into a single roll are known in the art. The document US 400,913 describes a roll of sheet material including sheet material formed from two webs, each web having lines of weakness positioned transversely across the web which allows the web to be separated into a plurality of sheets, the lines of weakness of one web being offset from those of the other.

The document WO 2007/068883 describes a roll adapted to be dispensed in a dispenser having rollers which form a nip therebetween. The roll includes material formed from two webs. Each web is configured to have lines of weakness positioned transversely across the web which allows the web to be separated into a plurality of sheets. The lines of weakness of one web are offset from those of the other. The lines of weakness are formed near each edge of the web such that when the roll is dispensed through a dispenser, the lines of weakness positioned near each edge separate first to facilitate sheets being dispensed singly from alternate webs as they are withdrawn from the dispenser. However, this is not satisfactory because the structure of the means for separating a sheet from the roll (flexible fingers), and also the means for adapting the sheets distribution (nip controller) to the weight of the roll that is reducing as a result of sheets distribution are complex.

SUMMARY

It is desired to propose a dispenser assembly that overcomes the above mentioned drawbacks, and in particular a dispenser assembly of simple construction enabling tangentially dispensing in a reliable manner tissue paper roll of the type including two overlapping webs formed into a single roll.

According to one aspect, there is provided a dispenser assembly for tangentially dispensing a sheet from a roll of sheet material, the roll of sheet material including sheet material formed from two webs, each web having lines of weakness positioned transversely across the web which allows the web to be separated into a plurality of sheets, the lines of weakness of one web being offset from those of the other web, the dispenser assembly including:

a base arranged to hold the roll of sheet material and to couple the dispenser assembly with an environment structure;

a first roller and a counter roller means between which the sheet material is movable towards a dispensing outlet;

wherein the dispenser assembly further includes a cradle arranged to support the roll of sheet material and to unwind the sheet material towards the first roller whatever a consumption level of the roll of sheet material;

and wherein the first roller and the counter roller means are positioned relatively to each other spaced according to a fixed nip therebetween such as to generate a braking force on the sheet material sufficient to break the line of weakness of the web at the dispensing outlet or downstream the dispensing outlet.

The roll of sheet material may be further supported by the first roller.

The first roller may be chosen among the group of rollers including a smooth roller, an embossing roller, a roller made of hard material, a roller made of steel, a roller made of a plastic material, a roller made of a flexible material, a roller made of elastomer, and a roller made of rubber.

The counter roller means may be chosen among the group of counter roller means including a smooth flat wall, smooth curved wall, a smooth roller, an embossing roller, a roller made of hard material, a roller made of steel, a roller made of a plastic material, a roller made of a flexible material, a roller made of elastomer, a roller made of rubber, and a combination of at least two deported rollers.

The cradle may have a shape arranged to match the cylindrical shape of the roll of sheet material.

The cradle may be formed as a single part or as multiple parts.

The cradle may have a bottom part positioned below a top part of the first roller.

The cradle may be further arranged to position the roll of sheet material against the first roller.

The dispenser assembly may further include at least one decoupling roller positioned upstream of the first roller, the free decoupling roller being arranged to decouple a rotation of the roll of sheet material from a rotation of the first roller whatever a clockwise or counterclockwise unwinding direction of the roll of sheet material.

The dispenser may include a cover coupled to the base, the first roller being associated with the base, the counter roller means being associated with the cover.

The dispenser may include a cover coupled to the base, the first roller and the counter roller means being associated with the base.

The dispenser may further include mechanical braking means acting on the at least one of the first roller and the counter roller means for generating a resistance against the free rotation of the at least one of the first roller and the counter roller means.

The dispenser may further include magnetic braking means generating a magnetic field acting on the at least one of the first roller and the counter roller means for generating a resistance against the free rotation of the at least one of the first roller and the counter roller means.

The roll of sheet material may be a tissue paper roll.

According to another aspect, there is provided a roll of sheet material arranged to be dispensed by a dispenser assembly according to an embodiment of the invention. The roll of sheet material may include sheet material formed from two webs, each web having lines of weakness positioned transversely across the web which allows the web to be separated into a plurality of sheets, the lines of weakness of one web being offset from those of the other.

Embodiments of the invention enable dispensing tissue paper roll of the type including two overlapping webs formed into a single roll. Embodiments of the invention greatly reduce the risk of over-spinning of the roll of sheet material and even jamming of the dispenser assembly when a user pulls the free end of the sheet too vigorously. Embodiments of the invention further greatly reduce the risk of breaking the sheet within the dispenser assembly.

Embodiments of the invention enable easy and quick authorized loading operations. This is particularly advantageous during maintenance of the dispenser assembly used in a commercial application context.

Further, embodiments of the invention prevent unauthorized stuffing action of the dispenser assembly by an unauthorized provider or operator by requiring said specific roll of sheet material. It enables the client of such dispenser assembly to have a specific, qualitative and controlled service during the maintenance operations.

Other advantages will become apparent from the hereinafter description of the invention.

BRIEF DESCRIPTION OF THE DRAWINGS

Embodiments of the invention are illustrated by way of examples and not limited to the accompanying drawings, in which like references indicate similar elements.

DETAILED DESCRIPTION OF PARTICULAR EMBODIMENTS

In the following description, the terminology "a roll of sheet material" has a large meaning encompassing, as examples, the rolls of paper towels, toilet tissues, plastic sheets or the like, metal sheets (e.g. aluminum) sheets or the like, food preservation bags, wraps, etc. . . . . The sheet material may be rolled as a continuous pre-perforated sheet. Further, the terminology "roll of sheet material" also covers either roll of sheet material having a core, or roll of sheet material being coreless. In particular, during the manufacturing process of the roll of sheet material, either the sheet material is wound into a cylinder onto a core (as an example a hollow cylinder made of cardboard, or a plastic mandrel, or a metallic axle, etc. . . . ), or the sheet material is wound into a cylinder on itself such as to define a central hollow cavity of substantially cylindrical shape and of variable size extending longitudinally.

The dispenser assembly may be used for residential or commercial applications for dispensing multiple of the hereinbefore mentioned sheets of material from a roll of sheet material.

The dispenser assembly may dispense the sheets of material from the roll of sheet material manually, i.e. a user may pull the sheet of material with a hand.

Figure 1:
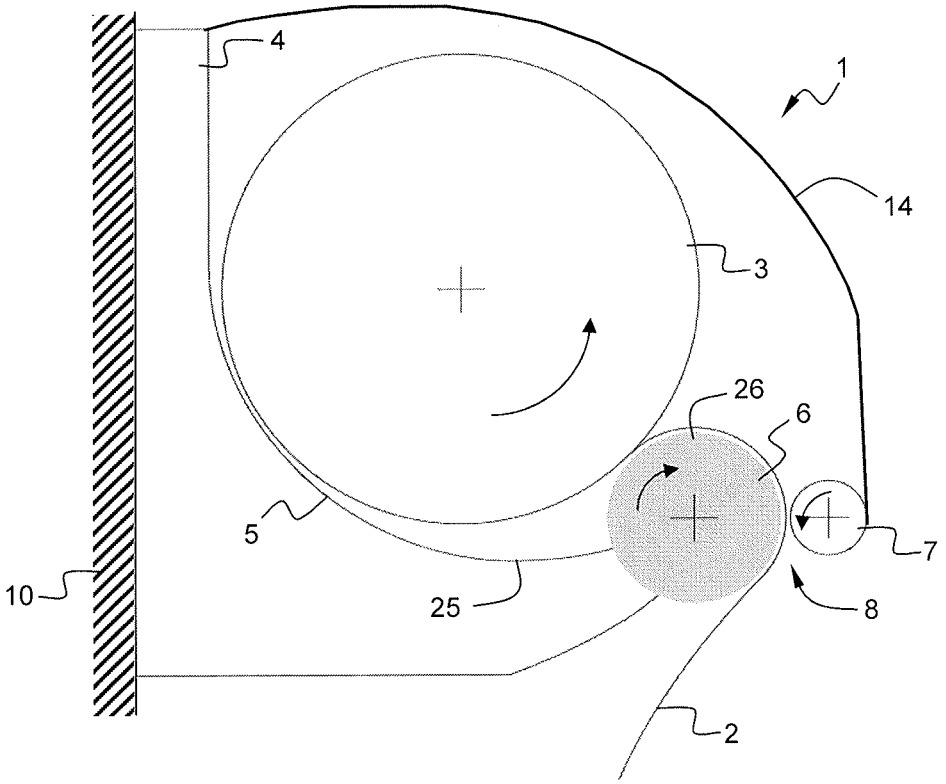
FIGS. 1 to 3A are side sectional views schematically illustrating the principle of operation of various embodiments of a dispenser assembly.
Figure 2:
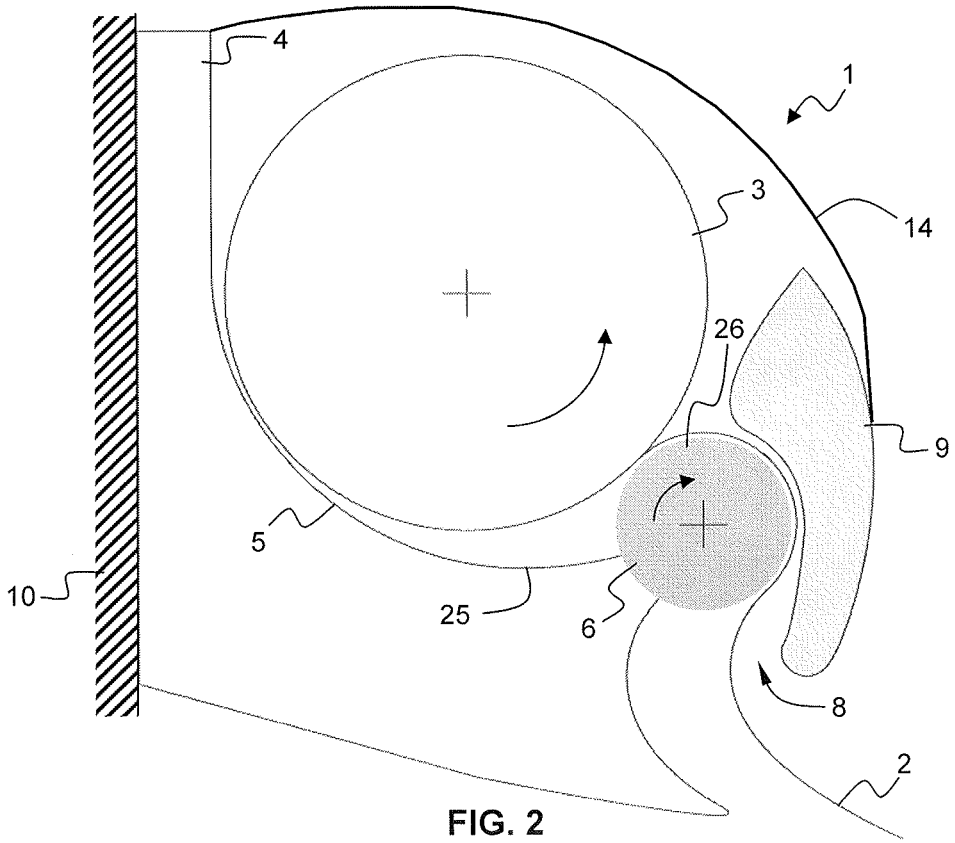
Figure 3:
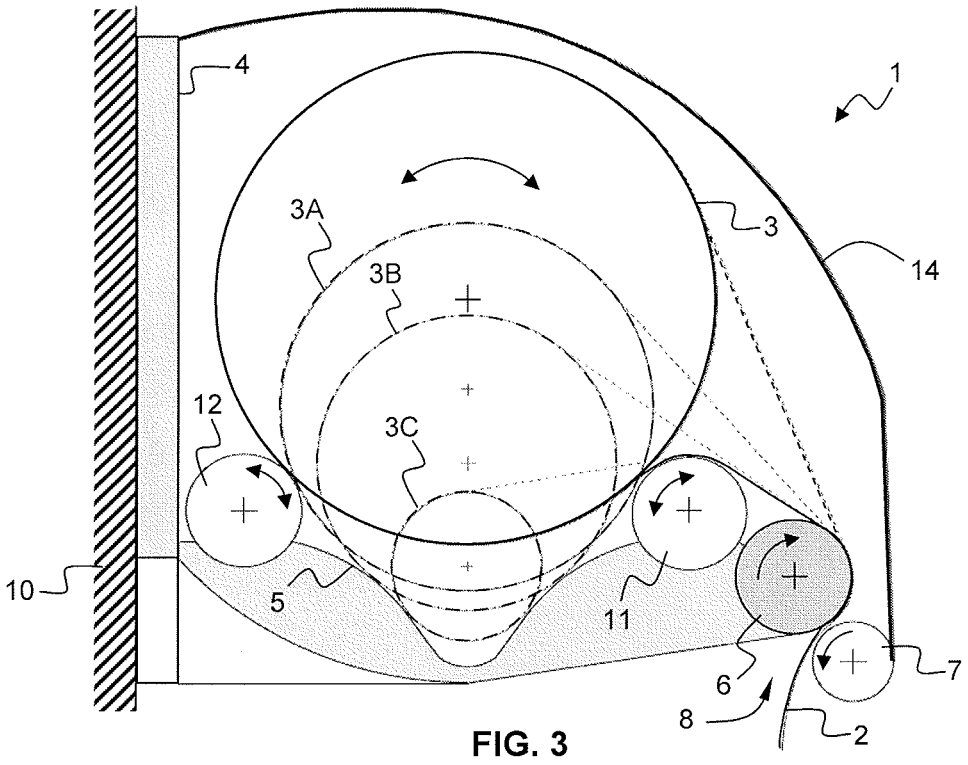
Figure 12:
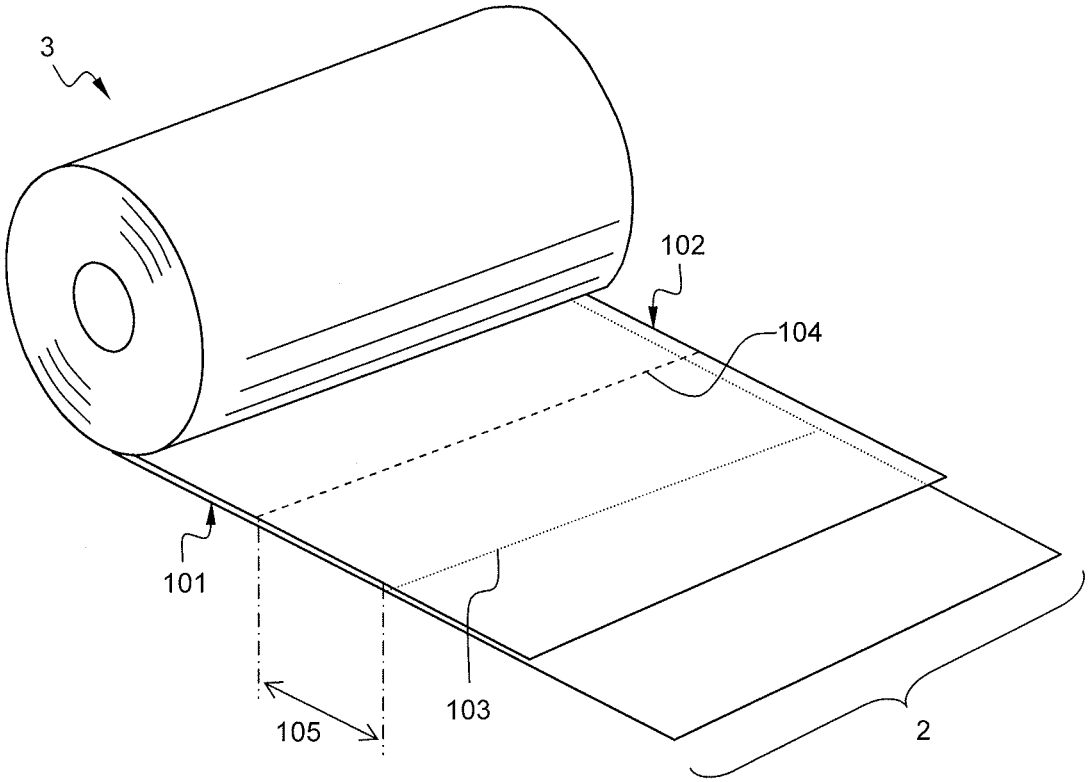
FIG. 12 schematically illustrates a tissue paper roll of the type including two overlapping webs including offset cutting lines.

FIGS. 1 to 3 schematically illustrate in side sectional views various embodiments of a dispenser assembly 1. In these embodiments, the dispenser assembly 1 is used to dispense a sheet 2 from a roll of sheet material 3 in a tangential manner. More precisely, the dispenser assembly 1 is used to dispense sheets of paper towel 2 from a tissue paper roll 3 of the type including two overlapping webs (formed into a single roll). As depicted in FIG. 12, the roll of paper towel 3 includes paper towel formed from two webs 101, 102. Each web 101, 102 has lines of weakness 103, 104, respectively, positioned transversely across the web which allows the web to be separated into a plurality of sheets 2. The lines of weakness 103 of one web 101 are offset 105 from those 104 of the other web 102.

FIGS. 1 to 3 also illustrate the principle of operation of various embodiments of the dispenser assembly.

The dispenser assembly 1 includes a base 4, a first roller 6 and a counter roller means 7, 9, a dispensing outlet 8, and a cradle 5.

The base 4 is arranged to hold the tissue paper roll 3. It further couples the dispenser assembly 1 with an environment structure 10. For example, it may be connected to a wall by various screws (not shown).

The sheet paper towel 2 is movable between the first roller 6 and the counter roller means 7, 9 towards the dispensing outlet 8.

The cradle 5 is arranged to support the tissue paper roll 3 and to unwind the sheet material towards the first roller 6 whatever a consumption level of the roll of sheet material. It enables adapting the frictional force exerted onto the tissue paper roll 3 that decreases with the level of consumption of the tissue paper roll (because the mass and also the inertia of the tissue paper roll decreases with said consumption level). The cradle enables always correctly positioning the tissue paper roll with respect to the first roller 6.

Figure 13:
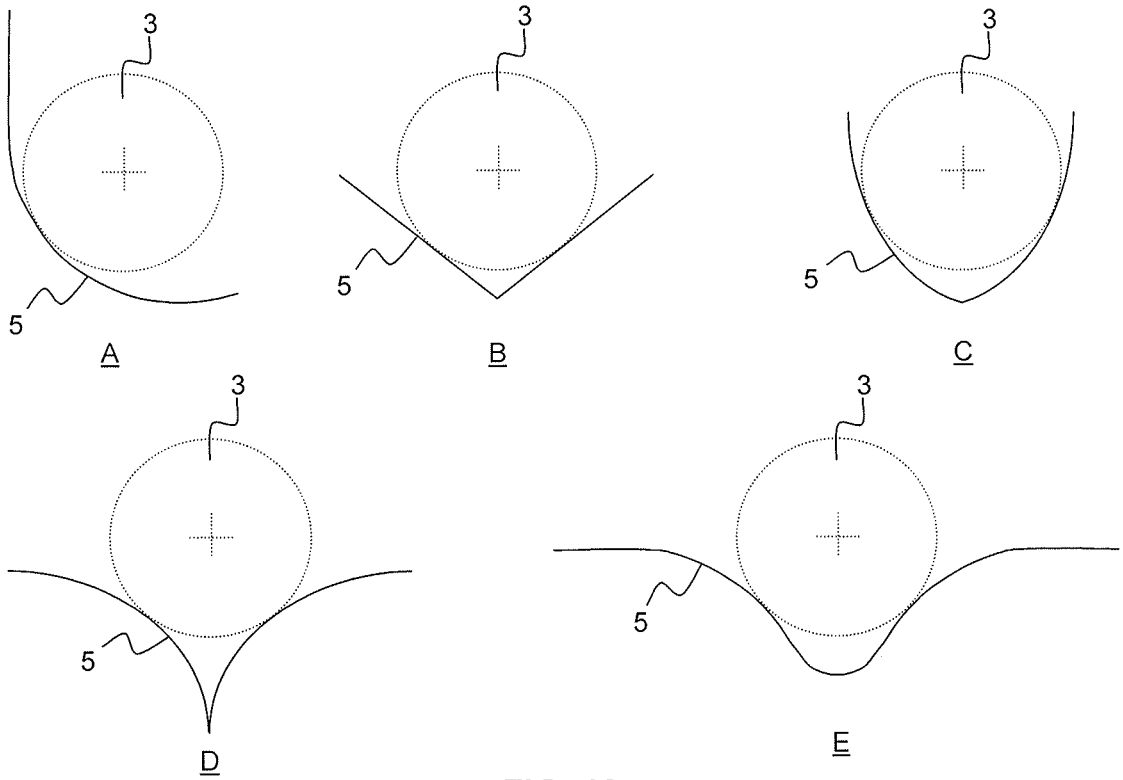
FIG. 13 schematically illustrates various examples of the cradle shape.

The cradle 5 has a shape arranged to match the cylindrical shape of the roll of sheet material 3. It may be a curved line or a complex shape combining multiple straight lines or curved lines (in cross-section). FIG. 13 schematically illustrates various examples of the cradle shape A, B, C, D and E. The cradle shape A is based on a single concave curved line offering a single contacting point or length to the roll 3. The cradle shape B is based on two straight lines symmetrically positioned with respect to each other offering two contacting points or lengths to the roll 3. The cradle shape C is based on two concave curved lines symmetrically positioned with respect to each other offering two contacting points or lengths to the roll 3. The cradle shape D is based on two convex curved lines symmetrically positioned with respect to each other offering two contacting points or lengths to the roll 3. The cradle shape E is based on two parts, each including a convex curved line portion combined to a concave curved line portion, both parts being symmetrically positioned with respect to each other and offering two contacting points or lengths to the roll 3.

In the embodiments of FIGS. 1 and 2, the cradle 5 is arranged to position the roll of sheet material 3 against the first roller 6. The shape of the cradle is a curved line (in cross-section). The cradle 5 has a bottom part 25 positioned below a top part 26 of the first roller 6. This enables always guiding the roll of sheet material 3 against the first roller 6 whatever the level of consumption of the roll of sheet material 3. Further, this configuration increases the surface of contact between the web and the first roller 6, thus increasing the friction and avoiding that the web slips onto the first roller 6. Thus, a better separation of the sheets of material from the web at the lines of weakness is obtained.

Figure 3A:
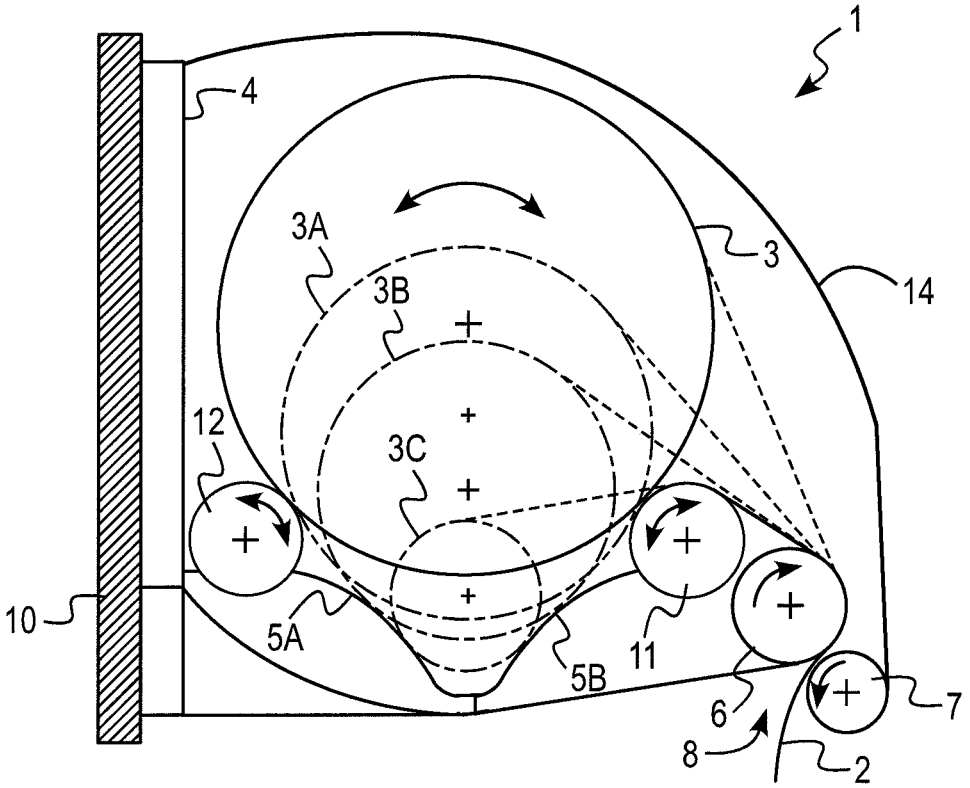

In the embodiment of FIG. 3, the shape is a combination of curved lines (in cross-section), for example a parabolic curve at the center combined with a curved line of inversed curvature at both edge (in cross-section). The cradle 5 further includes at least one free decoupling roller 11 positioned upstream the first roller 6. In the depicted example, the cradle 5 further includes a second free decoupling roller 12 symmetrically positioned relatively to the central parabolic curve and the first free decoupling roller 11. The free decoupling roller 11 is arranged to decouple the rotation of the roll of sheet material 3 from the rotation of the first roller 6 and to avoid jamming of the dispenser whatever the unwinding direction of the roll (clockwise or counterclockwise) within the dispenser 1. The sheet material may be unwound towards the first roller 6 by the bottom (plain lines) or by the top (dotted lines). The free decoupling roller 11 avoids the roll of sheet material 3 to contact against the first roller 6. Thus, this embodiment enables an operator to feed the dispenser without taking into account the unwinding direction of the roll (clockwise or counterclockwise). FIG. 3 further illustrates the roll of sheet material having various sizes 3, 3A, 3B, 3C depending on the level of sheet material having been dispensed. At the beginning of the dispensing operation, the roll of sheet material 3, 3A is supported by the free decoupling rollers 11 and 12, while at the end of the dispensing operation, the roll of sheet material 3B, 3C is supported by the central parabolic curve of the cradle 5. Alternatively, the central parabolic curve can be provided by two parts of the cradle 5A and 5B, as illustrated schematically in FIG. 3A.

As an alternative (not depicted), the free decoupling roller 11 may be replaced by a braked decoupling roller 11. This enables avoiding over rolling of the roll of sheet material 3 within the dispenser assembly that would result in jamming the dispenser assembly.

The first roller 6 and the counter roller means 7, 9 are positioned relatively to each other spaced according to a fixed nip therebetween. This is used to generate a braking force on the sheet material sufficient to break the line of weakness of the web at the dispensing outlet 8 or downstream of the dispensing outlet 8. This enables always having a piece of sheet material available for grasping outside the dispensing outlet 8. This further prevents breaking the line of weakness of the web upstream the dispensing outlet 8. This would result in preventing further dispensing of the sheet material or otherwise requires opening the dispenser in order to correctly position the sheet material between the first roller 6 and the counter roller means 7, 9.

In the embodiments of FIGS. 1 and 3, the counter roller means is another roller 7. Various alternatives are possible as depicted in FIGS. 4 to 7 and explained hereinafter. Alternatively, the counter roller means may also include two counter rollers (not shown) increasing breaking and friction.

In the embodiment of FIG. 2, the counter roller means 9 includes an element having a smooth curved wall orientated towards the first roller 6. The web of sheet material easily slides along the smooth curved wall. Alternatively, the counter roller means may be a smooth flat wall (not represented). Alternatively, the respective position of the first roller 6 and the counter roller means 9 may be inversed.

The dispenser may further include a cover 14 coupled to the base 4. The first roller 6 may be secured to the base 4. The counter roller means 7, 9 may be secured to the cover 14. The cover 14 may be secured to the base 4 through appropriate locking means. Further, a spring means (not shown) may be provided between the cover 14 and the base 4 enabling applying the first roller 6 against the counter roller means 7, 9, and also easing opening the cover 14.

Figure 4:
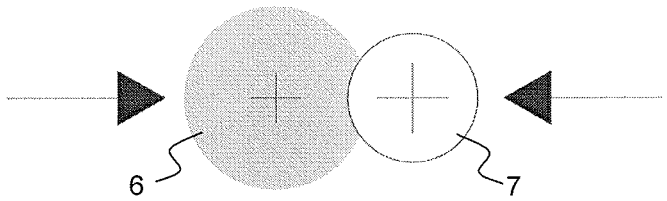
FIGS. 4 to 6 are side sectional views schematically illustrating different embodiments of roller and a counter roller means.
Figure 5:
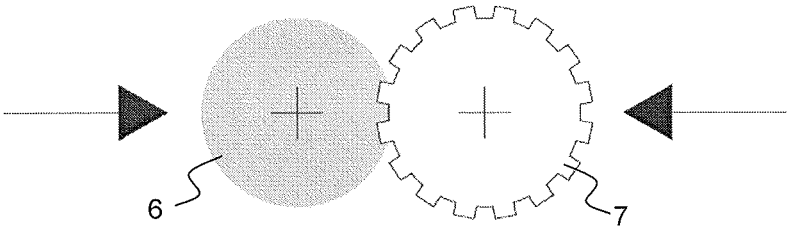
Figure 6:
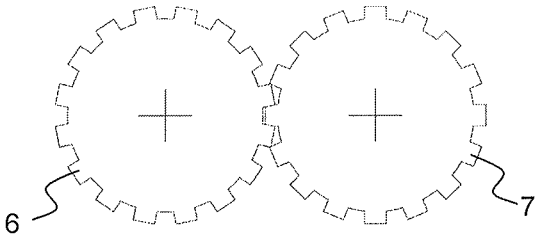

FIGS. 4 to 6 are side sectional views schematically illustrating different embodiments of a roller 6 associated with a counter roller means 7. This association generates a continuous braking force on the sheet material that, combined with the pulling force applied by the user, is sufficient to break the line of weakness of the web at the dispensing outlet 8 or downstream the dispensing outlet 8.

In the embodiment of FIG. 4, the first roller 6 is a smooth roller made of a flexible material, while the counter roller means 7 is a smooth roller made of a hard material. For example, the roller 6 is an elastomer roller, a rubber roller, etc. . . . . Alternatively, it may be a roller coated with an elastomer or a rubber coating. For example, the counter roller means 7 is a roller made of a hard plastic material, a roller made of steel, etc. . . . .

In the embodiment of FIG. 5, the first roller 6 is a smooth roller made of a flexible material, while the counter roller means 7 is an embossing roller. For example, the roller 6 is an elastomer roller, a rubber roller, etc. . . . . Alternatively, it may be a roller coated with an elastomer or a rubber coating. The embossing roller 7 may be provided with an embossing pattern in order to generate esthetic effects on the sheet material when it is distributed. The embossing pattern may include dots, curved lines, straight lines or a combination of them. For example, the embossing roller is made of a hard plastic material, of steel, etc. . . . .

In the embodiment of FIG. 6, both the first roller 6 and the counter roller means 7 are embossing rollers operating in a male/female relationship. The first roller 6 and the embossing roller 7 may be provided with an embossing motive in order to generate esthetic effects on the sheet material when it is distributed. For example, both rollers are made of a hard plastic material, of steel, etc. . . . .

Figure 7:
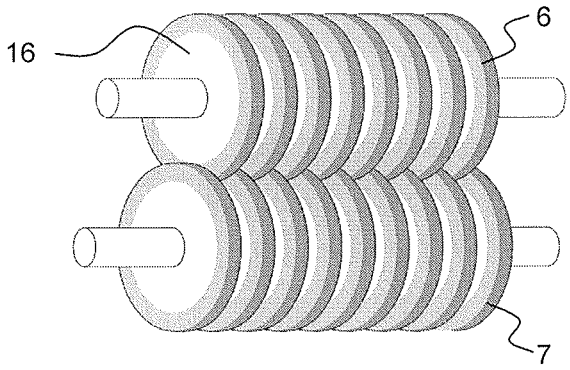
FIG. 7 is a perspective view schematically illustrating another embodiment of a roller and a counter roller means.

In the embodiment of FIG. 7, both the first roller 6 and the counter roller means 7 are linear embossing rollers operating in a male/female relationship. Each linear embossing roller includes a train of multiple wheels 16. As an example, both linear embossing rollers are rollers coated with an elastomer or a rubber coating. A further anti-jamming means (not shown) may be provided between two consecutive wheels of each linear embossing roller.

Figure 8:
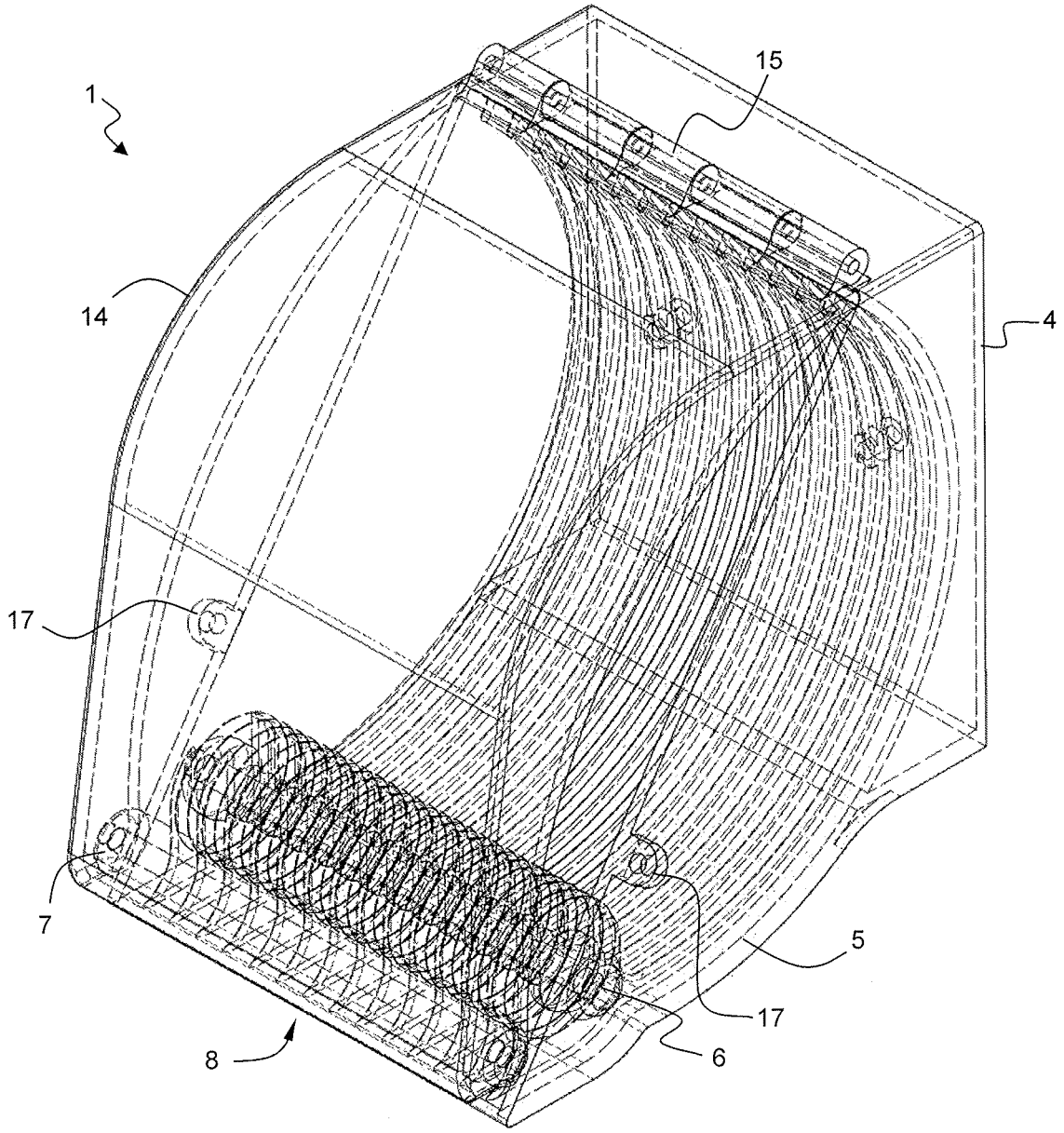
FIG. 8 is a perspective and partially transparent view of an exemplary embodiment of a dispenser assembly.
Figure 9:
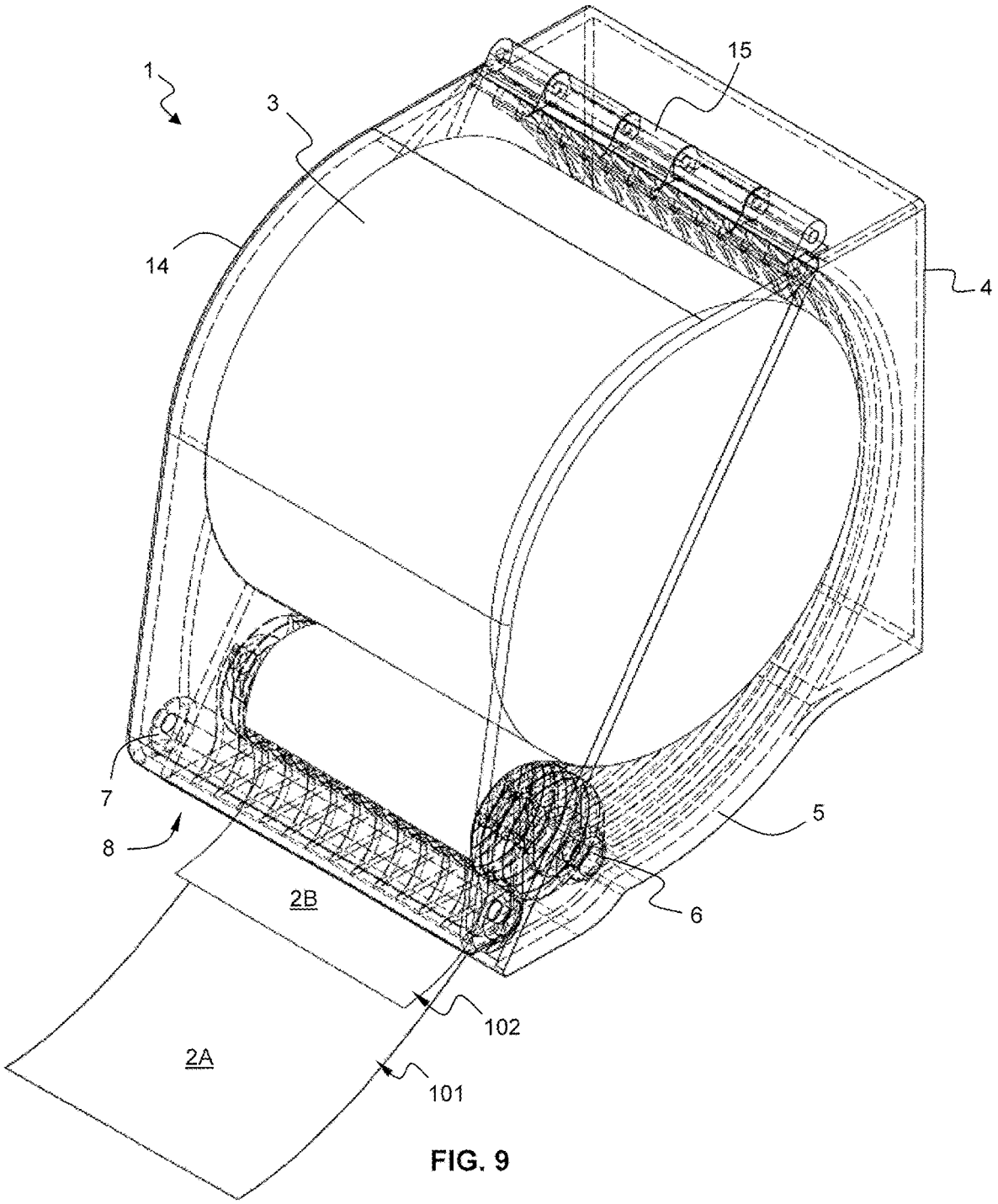
FIG. 9 is a perspective and partially transparent view of an exemplary embodiment of a dispenser assembly of FIG. 8 holding and dispensing a roll of sheet material.
Figure 10:
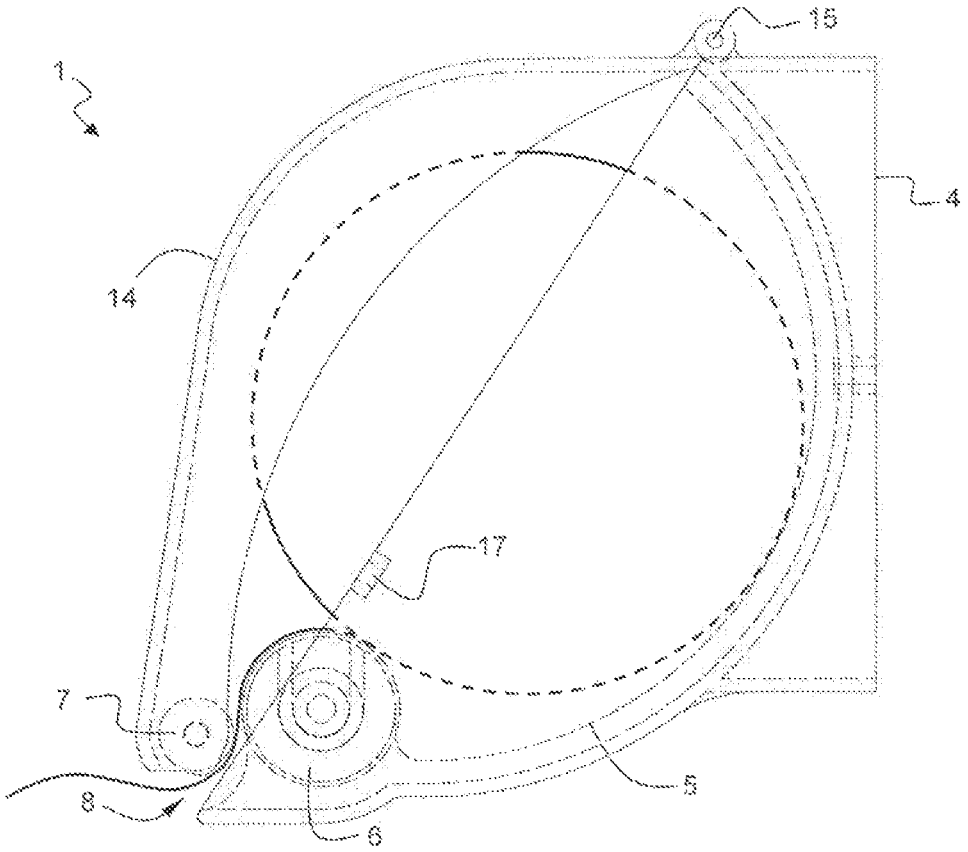
FIG. 10 is a side and partially transparent view of an exemplary embodiment of the dispenser assembly depicted in FIGS. 8 and 9.

FIG. 8 is a perspective and partially transparent view of a dispenser assembly according to the first embodiment of the invention schematically depicted in FIG. 1. FIG. 9 is a perspective and partially transparent view of the dispenser assembly of FIG. 8 further depicting how the roll of sheet material is held and how the sheets are dispensed. FIG. 10 is a side and partially transparent view of the dispenser assembly depicted in FIGS. 8 and 9.

When filling the dispenser assembly 1, an operator opens the cover 14 that is coupled to the base 4 through a hinge arrangement 15. The roll of sheet material 3 is laid down onto the cradle 5 and contacts the first roller 6. A few first sheets 2 are pulled from the roll of sheet material 3 without breaking the web and laid down onto the first roller 6. The cover 14 is closed so as to apply the counter roller means 7 associated to the cover 14 onto the sheets 2 and the first roller 6, and define the fixed nip between the first roller 6 and the counter roller means 7. When closed, the cover 14 rests onto the base 4 by its own weight. Alternatively, the cover 14 may be further secured to the base 4 through appropriate locking means 17. The few first sheets 2 protrude out of the opening 8. Due to the sheet material formed from two webs 101, 102 (as depicted in details in FIG. 12), each web 101, 102 having lines of weakness 103, 104 positioned transversely across the web which allows the web 101, 102 to be separated into multiple sheets 2, the lines of weakness 103 of one web 101 being offset 105 from those 104 of the other web 102, one sheet 2A may be separated from the roll by the combined action of a user pulling onto the edge of the sheet 2A and the braking force applied by the first roller 6 and the counter roller means 7. At the same time, the edge of another sheet 2B has passed the opening 8 and is ready to be grasped (see FIG. 9).

Figure 11:
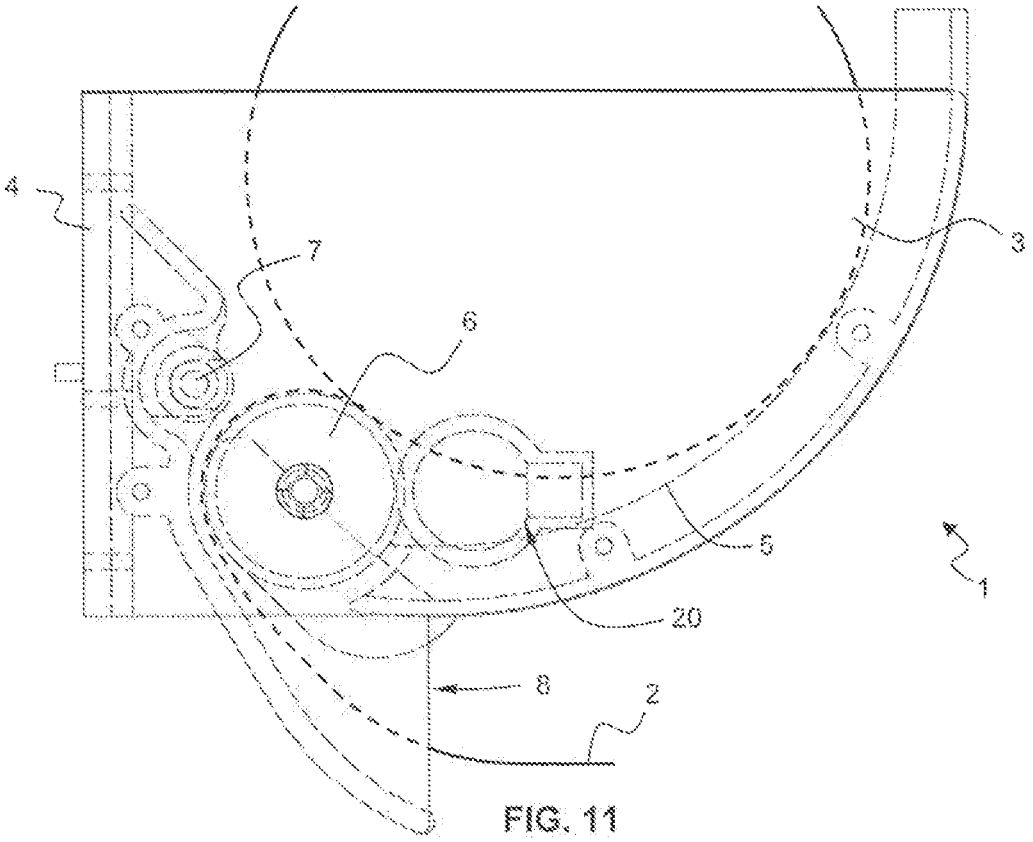
FIGS. 11 to 11A are side and partially transparent views of other exemplary embodiments of the dispenser assembly.

FIG. 11 is a side and partially transparent view of another exemplary embodiment of the dispenser assembly.

Figure 11A:
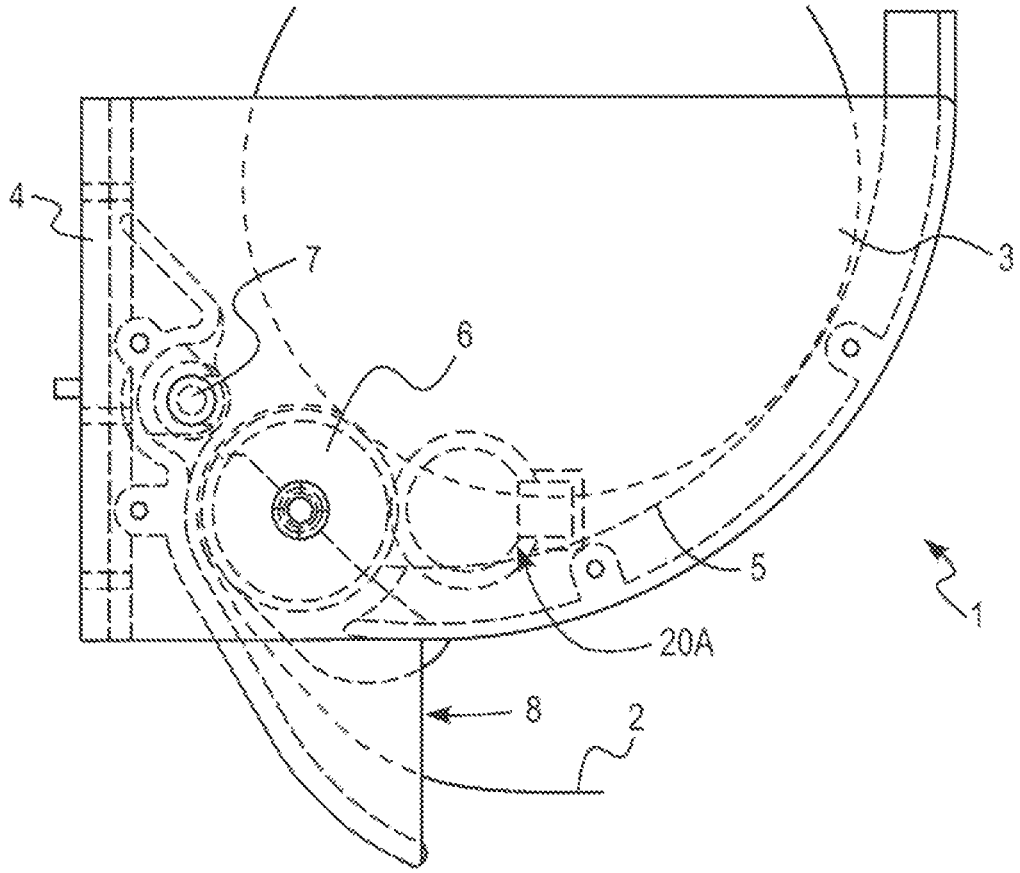

In this embodiment, the first roller 6 and the counter roller means 7 are secured to the base 4. The cover (not shown) may be omitted. The roll of sheet material 3 is merely put onto the cradle 5 and contacts the first roller 6. The dispenser further includes a magnetic braking means 20 for generating a magnetic field acting on the at least one of the first roller 6 and/or the counter roller means 7. This magnetic field generates a resistance against the free rotation of the at least one of the first roller 6 and/or the counter roller means 7. For example, the magnetic braking means 20 includes a first magnet positioned in the first roller and another magnet closely positioned in/on the base. In the depicted embodiment, the magnetic braking means 20 is positioned close to the first roller 6 so as to generate a magnetic field braking the rotation of the first roller 6. Alternatively, the magnetic braking means 20 may be replaced by a mechanical braking means 20A, as illustrated schematically in FIG. 11A.

Figure 14:
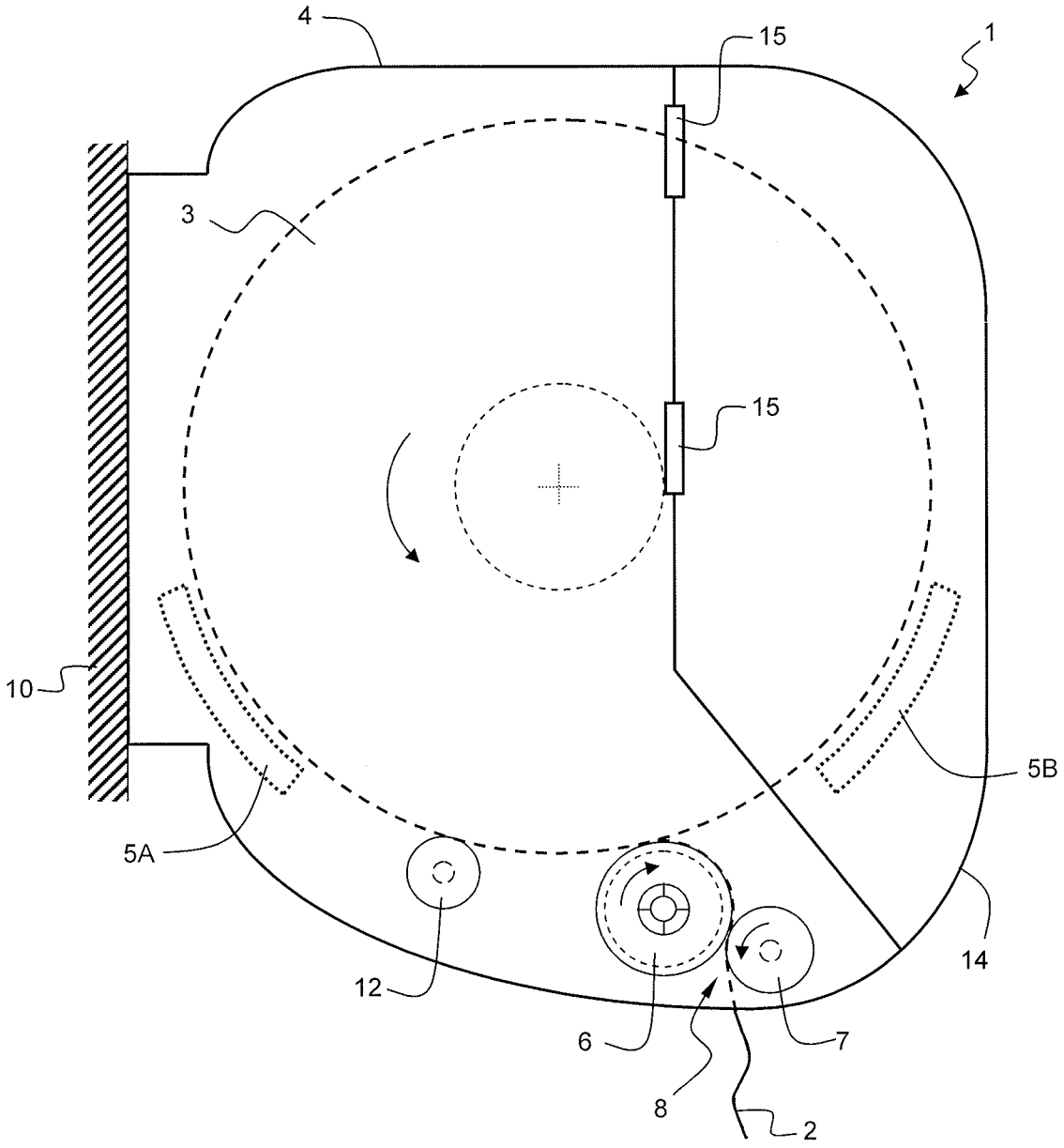
FIG. 14 is a side and partially transparent view of a further exemplary embodiment of the dispenser assembly.

FIG. 14 is a side and partially transparent view of a further exemplary embodiment of the dispenser assembly. This further embodiment differs from the exemplary embodiments of FIGS. 1-3 and 8-10 in that the first roller 6 and the counter roller means 7 are both associated with the base 4, in that the cradle 5 is formed as multiple parts 5A and 5B, and in that the roll of sheet material 3 is supported by the first roller 6 and an additional free decoupling roller 12. More precisely, the cradle 5 is formed as a first part 5A and a second part 5B. The first part 5A is positioned behind the roll 3 and associated with the base 4. The second part 5B is positioned in front of the roll 3 and associated with either the base 4 or the cover 14. The two parts of the cradle 5A and 5B enables retaining the roll of sheet material 3 towards a rest position on the first roller 6 and additional free decoupling roller 12. This may be of particular interest where a user pulls the free end of the sheet 2 such a way that the roll is put in an over-spinning situation within the dispenser assembly. Though, the drawing shows the counter roller means 7 positioned on the right of the first roller 6, the counter roller means 7 may also be positioned below the first roller 6 in a given dispenser assembly. The relative position of the first roller 6 and the counter roller means 7 defines the exit position and angle of the free end of the sheet 2.

According to this embodiment, when user pulls the free end of the sheet 2, said sheet drives the first roller 6 and the counter roller means 7, the first roller 6 driving in rotation of the roll of sheet material 3. Thus, the roll of sheet material 3 only rotates on demand, greatly reducing the risk of over-spinning and jamming. Further, due to the presence of the free decoupling roller 12, the roll of sheet material 3 is not braked by its own weight. This in combination with the fact that the roll is also supported by the first roller greatly reduces the risk of breaking the line of weakness of the web upstream of the nip between the first roller 6 and the counter roller means 7, and also upstream of the dispensing outlet 8.

This embodiment is particularly adapted to dispense sheet material from a roll of important size. As an example, the roll has a width around 210 mm, a diameter around 195 mm and a core diameter around 40 mm. Such rolls of sheet material may be typically used in professional/commercial applications.

The drawings and their descriptions hereinbefore illustrate embodiments of, rather than limit, the invention.

The depicted embodiments of dispensers in FIGS. 1-3, 8-10 and 14 illustrate a particular example of a base coupled to a housing cover. The housing cover is advantageous for hygiene reasons because it prevents users from touching the roll of sheet material. However, another kind of base, for example providing an open access to the roll of sheet material may be convenient provided that the counter roller means is positioned relatively to the first roller spaced according to a fixed nip therebetween such as to generate a braking force on the sheet material sufficient to break the line of weakness of the web at or downstream of the dispensing outlet as described hereinbefore.

Further, though the figures illustrate a roll of sheet material freely supported by the cradle, the roll of sheet material may alternatively be further held by its core through an axis or plug(s) which displacement is controlled within the dispenser assembly in dependence on the consumption level of the roll of sheet material. For example, the axis or plug ends may be supported by a lateral groove disposed in the cover or base. The plug associated with one side face of the roll of sheet material may further cooperate with an appropriate slot associated with the base of the dispenser assembly forming a foolproof means that helps the user to correctly position the roll of sheet material in the dispenser assembly.

Any reference sign in a claim should not be construed as limiting the claim. The word "comprising" does not exclude the presence of other elements than those listed in a claim. The word "a" or "an" preceding an element does not exclude the presence of a plurality of such element.

The invention claimed is:

1. A dispenser assembly for tangentially dispensing one of a plurality of sheets from a roll of sheet material, the roll of sheet material comprising sheet material formed from two webs, each web having lines of weakness positioned transversely across the web which allows the web to be separated into at least one of the plurality of sheets, the lines of weakness of one web being offset from those of the other web, the dispenser assembly comprising:

a base for holding the roll of sheet material in a roll holding location and is configured to couple the dispenser assembly with an environment structure;

a first roller and a counter roller configured in the dispenser assembly so as to form a fixed nip between each other so as to apply a continuous braking force on the sheet material while the sheet material is being dispensed, the dispenser assembly configured such that the sheet material is movable through the nip towards a dispensing outlet of the dispenser assembly, an axis of the first roller being arranged directly between an axis of the counter roller and the roll holding location in the dispenser assembly;

first and second decoupling rollers positioned upstream and spaced from the first roller, the first and second decoupling rollers being rotatably arranged above a horizontal plane extending through the nip at a distance from each other so as to support the roll of sheet material when the roll of sheet material is in the roll holding location in the dispenser assembly, wherein when the roll of sheet material is in the roll holding location in the dispenser assembly, the roll of sheet material contacts the first and second decoupling rollers and does not contact the first roller or the counter roller until a portion of the roll of sheet material is unwound from the roll; and a cradle extending in a direction parallel to the first roller and the counter roller, the cradle being arranged to support the roll of sheet material such that the sheet material can be unwound towards the first roller, wherein the cradle contacts the roll of sheet material at least at two sites after tangential dispensing of the plurality of sheets results in the roll of sheet material having a diameter too small to contact both the first and second decoupling rollers at an end of the dispensing operation;

the first and second decoupling rollers and/or the cradle are configured to support the roll of sheet material such that the sheet material can be unwound from either the top or the bottom of the roll of sheet material;

wherein the nip between the first roller and the counter roller is configured to generate a braking force on the sheet material sufficient to break one of the lines of weakness of one of the two webs at the dispensing outlet or downstream of the dispensing outlet and thus leave another of the two webs protruding from the dispenser outlet so that the other of the webs is ready to be grasped; and wherein the dispenser assembly further includes a cover coupled to the base, the first roller being connected to the base, the counter roller being directly secured to the cover such that the nip between the counter roller and the first roller is expanded when the cover is opened.

2. The dispenser assembly of claim 1, wherein the dispenser assembly is configured so that, when the roll of sheet material is in the dispenser, at least one of the plurality of sheets of the roll of sheet material is further supported by the first roller.

3. The dispenser assembly of claim 1, wherein the first roller is chosen from the group consisting of: a smooth roller, an embossing roller, a roller made of hard material, a roller made of steel, a roller made of a plastic material, a roller made of a flexible material, a roller made of elastomer, and a roller made of rubber.

4. The dispenser assembly according to claim 1, wherein the counter roller is chosen from the group consisting of: a smooth flat wall, smooth curved wall, a smooth roller, an embossing roller, a roller made of hard material, a roller made of steel, a roller made of a plastic material, a roller made of a flexible material, a roller made of elastomer, and a roller made of rubber.

5. The dispenser assembly according to claim 1, wherein the cradle has a shape that matches a cylindrical shape.

6. The dispenser assembly according to claim 1, wherein the cradle is formed as multiple parts.

7. The dispenser assembly according to claim 1, wherein the cradle has a bottom part positioned below a top part of the first roller.

8. The dispenser assembly according to claim 1, wherein the dispenser assembly further includes a cover coupled to the base, the first roller being connected to the base, the counter roller being associated with the cover.

9. The dispenser assembly according to claim 1, wherein the dispenser assembly further includes a cover coupled to the base, the first roller and the counter roller being connected to the base.

10. The dispenser assembly according to claim 1, wherein the dispenser assembly further comprises a magnetic brake that generates a magnetic field acting on at least one of the first roller or the counter roller for generating a resistance against the free rotation of the at least one of the first roller or the counter roller.

11. The dispenser assembly according to claim 1, wherein the dispenser assembly further comprises a mechanical brake acting on at least one of the first roller or the counter roller for generating a resistance against the free rotation of the at least one of the first roller or the counter roller.

12. The dispenser assembly according to claim 1, wherein an axis of the first roller is closer to the roll holding location than is an axis of the counter roller.

* * * * *